US009972464B2

(12) United States Patent
Tsai et al.

(10) Patent No.: US 9,972,464 B2
(45) Date of Patent: May 15, 2018

(54) KEY STRUCTURE

(71) Applicant: Primax Electronics Ltd., Taipei (TW)

(72) Inventors: Lei-Lung Tsai, Taipei (TW); Yi-Shu Lee, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days. days.

(21) Appl. No.: 15/366,374

(22) Filed: Dec. 1, 2016

(65) Prior Publication Data

US 2018/0075987 A1 Mar. 15, 2018

(30) Foreign Application Priority Data

Sep. 14, 2016 (TW) ..... 105130009 A

(51) Int. Cl.

| | |
|---|---|
| ***H01H 1/10*** | (2006.01) |
| ***H01H 13/705*** | (2006.01) |
| ***H01H 3/12*** | (2006.01) |
| ***H01H 5/04*** | (2006.01) |

(52) U.S. Cl.

CPC ..... *H01H 13/705* (2013.01); *H01H 3/12* (2013.01); *H01H 5/04* (2013.01)

(58) Field of Classification Search

CPC ..... H01H 13/705; H01H 3/12; H01H 5/04; H01H 3/125; H01H 13/14; H01H 2203/038; H01H 2215/012; H01H 2237/00

USPC ..... 200/517, 344

See application file for complete search history.

(56) References Cited

U.S. PATENT DOCUMENTS

| | | | | |
|---|---|---|---|---|
| 6,371,671 | B1 * | 4/2002 | Sato | H01H 3/125 400/472 |
| 6,586,695 | B2 * | 7/2003 | Sato | H01H 3/122 200/344 |
| 7,138,587 | B2 * | 11/2006 | Nishino | H01H 3/122 200/344 |
| 7,649,151 | B2 * | 1/2010 | Li | H01H 3/40 200/344 |
| 8,614,401 | B2 * | 12/2013 | Tseng | H01H 13/807 200/5 A |
| 8,624,140 | B2 * | 1/2014 | Nishino | H01H 3/122 200/302.2 |
| 8,779,308 | B2 * | 7/2014 | Takemae | H01H 13/14 200/341 |

* cited by examiner

*Primary Examiner* — Kyung Lee

(74) *Attorney, Agent, or Firm* — Muncy, Geissler, Olds & Lowe, P.C.

(57) ABSTRACT

A key structure includes a base plate, a keycap and a connecting element. The connecting element includes a first frame and a second frame. The first frame is connected with the base plate and the keycap. The first frame includes a first linking part. The second frame is connected with the base plate and the keycap. The second frame includes a second linking part. The second linking part is contacted with the first linking part. When a depressing force from the user is applied to the keycap, the first frame is swung relative to the second frame. Moreover, in response to a friction between the first linking part and the second linking part, the keycap is correspondingly moved.

10 Claims, 5 Drawing Sheets

KEY STRUCTURE

FIELD OF THE INVENTION

The present invention relates to a key structure, and more particularly to a slim-type key structure.

BACKGROUND OF THE INVENTION

Generally, the widely-used peripheral input device of a computer system includes for example a mouse, a keyboard, a trackball, or the like. Through the keyboard, characters or symbols can be inputted into the computer system directly. As a consequence, most users and most manufacturers of input devices pay much attention to the development of keyboards. As known, a keyboard with scissors-type connecting elements is one of the widely-used keyboards.

A keyboard with scissors-type connecting elements will be illustrated as follows. For succinctness, only one key structure is shown in the drawing. FIG. 1 is a schematic exploded view illustrating a key structure of conventional keyboard. As shown in FIG. 1, the conventional key structure 1 comprises a keycap 11, a scissors-type connecting element 12, a rubbery elastomer 13, a membrane switch circuit member 14 and a base plate 15. The keycap 11, the scissors-type connecting element 12, the rubbery elastomer 13 and the membrane switch circuit member 14 are supported by the base plate 15. The scissors-type connecting element 12 is used for connecting the base plate 15 and the keycap 11.

The membrane switch circuit member 14 comprises plural key intersections (not shown). When one of the plural key intersections is triggered, a corresponding key signal is generated. The rubbery elastomer 13 is disposed on the membrane switch circuit member 14. Each rubbery elastomer 13 is aligned with a corresponding key intersection. When the rubbery elastomer 13 is depressed, the rubbery elastomer 13 is subjected to deformation to push the corresponding key intersection of the membrane switch circuit member 14. Consequently, the corresponding key signal is generated.

The scissors-type connecting element 12 is arranged between the base plate 15 and the keycap 11, and the base plate 15 and the keycap 11 are connected with each other through the scissors-type connecting element 12. The scissors-type connecting element 12 comprises a first frame 121 and a second frame 122. A first end of the first frame 121 is connected with the keycap 11. A second end of the first frame 121 is connected with the base plate 15. The rubbery elastomer 13 is enclosed by the scissors-type connecting element 12. The first frame 121 comprises a rotary shaft 1211. The rotary shaft 1211 is disposed on a sidewall of the first frame 121. The second frame 122 has a pivotal hole 1221 corresponding to the rotary shaft 1211. After the rotary shaft 1211 is inserted into the pivotal hole 1221, the first frame 121 and the second frame 122 are combined together. Consequently, first frame 121 can be swung relative to the second frame 122, and the keycap 11 can be moved upwardly or downwardly in a stable manner.

The operations of the conventional key structure 1 in response to the depressing action of the user will be illustrated as follows. Please refer to FIG. 1 again. When the keycap 11 is depressed, the keycap 11 is moved downwardly to push the scissors-type connecting element 12 in response to the depressing force. As the keycap 11 is moved downwardly relative to the base plate 15, the keycap 11 pushes the corresponding rubbery elastomer 13. At the same time, the rubbery elastomer 13 is subjected to deformation to push the membrane switch circuit member 14 and trigger the corresponding key intersection of the membrane switch circuit member 14. Consequently, the membrane switch circuit member 14 generates a corresponding key signal. When the keycap 11 is no longer depressed by the user, no external force is applied to the keycap 11 and the rubbery elastomer 13 is no longer pushed by the keycap 11. In response to the elasticity of the rubbery elastomer 13, the rubbery elastomer 13 is restored to its original shape to provide an upward elastic restoring force. Consequently, the keycap 11 is returned to its original position where it is not depressed.

However, the conventional key structure 1 still has some drawbacks. For allowing the scissors-type connecting element 12 to be stably swung, the sizes of the rotary shaft 1211 and the pivotal hole 1221 should be accurately designed and produced. If the production tolerances of the rotary shaft 1211 and the pivotal hole 1221 are too large, the scissors-type connecting element 12 is suffered from a rocking problem. Because of the rocking problem, the movement of the keycap 11 is unstable.

Therefore, there is a need of providing a key structure with enhanced depressing stability.

SUMMARY OF THE INVENTION

The present invention provides a key structure with enhanced depressing stability.

In accordance with an aspect of the present invention, there is provided a key structure. The key structure includes a base plate, a keycap and a connecting element. The keycap is disposed over the base plate. When a depressing force is received by the keycap, the keycap is moved relative to the base plate. The connecting element is arranged between the base plate and the keycap. The base plate and the keycap are connected with each other through the connecting element. As the connecting element is swung, the keycap is correspondingly moved relative to the base plate. The connecting element includes a first frame and a second frame. The first frame is located at a first side of the key structure. A first end of the first frame is connected with the base plate. A second end of the first frame is connected with the keycap. The first frame includes a first linking part. The first linking part is formed on the second end of the first frame. The second frame is located at a second side of the key structure. A first end of the second frame is connected with the base plate. A second end of the second frame is connected with the keycap. The second frame includes a second linking part. The second linking part is formed on the second end of the second frame and contacted with the first linking part. When the depressing force is received by the keycap, the first frame is swung relative to the second frame, and the keycap is correspondingly moved in response to a friction between the first linking part and the second linking part.

In accordance with another aspect of the present invention, there is provided a key structure. The key structure includes a base plate, a keycap and a connecting element. The keycap is disposed over the base plate. When a depressing force is received by the keycap, the keycap is moved relative to the base plate. The keycap includes a first linking part. The first linking part is disposed on a bottom surface of the keycap. The connecting element is arranged between the base plate and the keycap. The base plate and the keycap are connected with each other through the connecting element. As the connecting element is swung, the keycap is correspondingly moved relative to the base plate. The connecting element includes at least one frame. The at least one frame is located at a side of the key structure. A first end of the at least one frame is connected with the base plate. A second end of the at least one frame is connected with the keycap. The at least one frame includes a second linking part. The second linking part is formed on the second end of the at least one frame and contacted with the first linking part. When the depressing force is received by the keycap, the second linking part is rotated with the first linking part and the at least one frame is swung, so that the keycap is correspondingly moved.

From the above descriptions, the key structure of the present invention provides a key structure. The key structure includes a non-scissors connecting element. As the connecting element is swung, a keycap is correspondingly moved. Due to the contact between a first linking part and a second linking part, the keycap is moved with the connecting element. The key structure of the present invention provides a mechanism to compensate the production tolerances of associated components. Consequently, the keycap can be stably moved, and the rocking extent during the movement of the keycap is reduced.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

For solving the drawbacks of the conventional technologies, the present invention provides a key structure with enhanced depressing stability.

Figure 1:
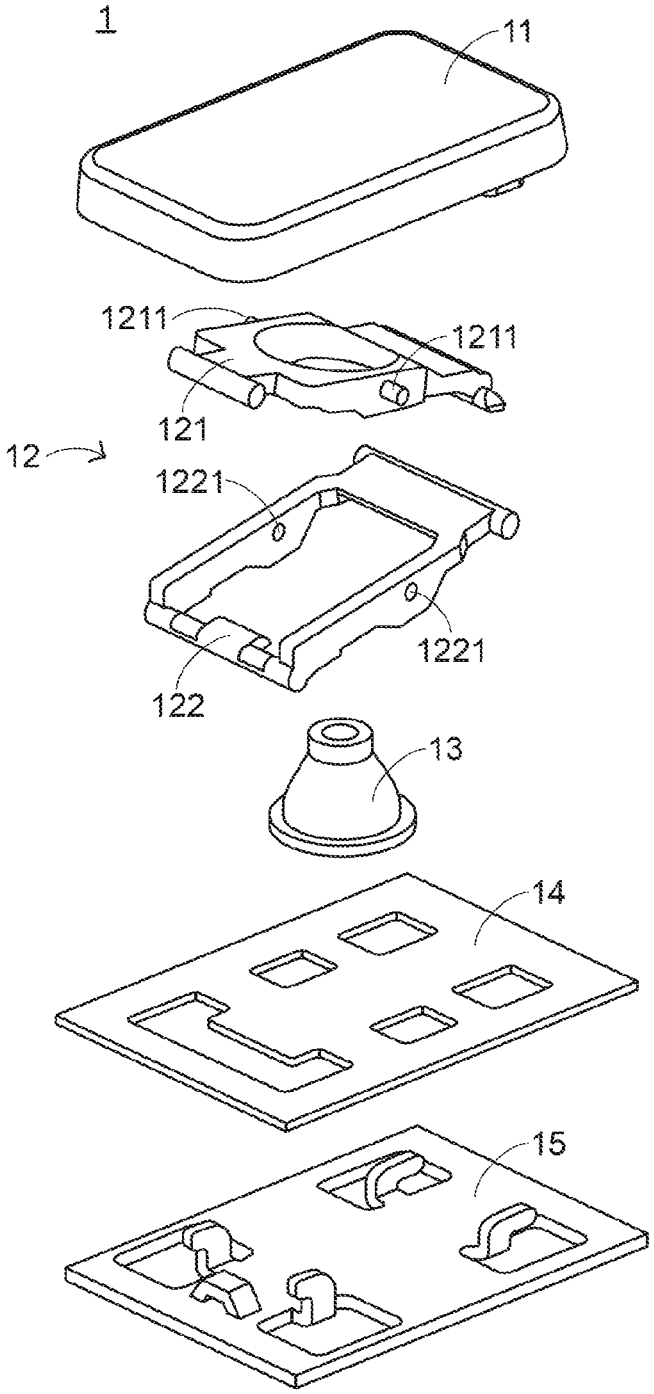
FIG.1 PRIOR ART
FIG. 1 is a schematic exploded view illustrating a key structure of conventional keyboard.
Figure 2:
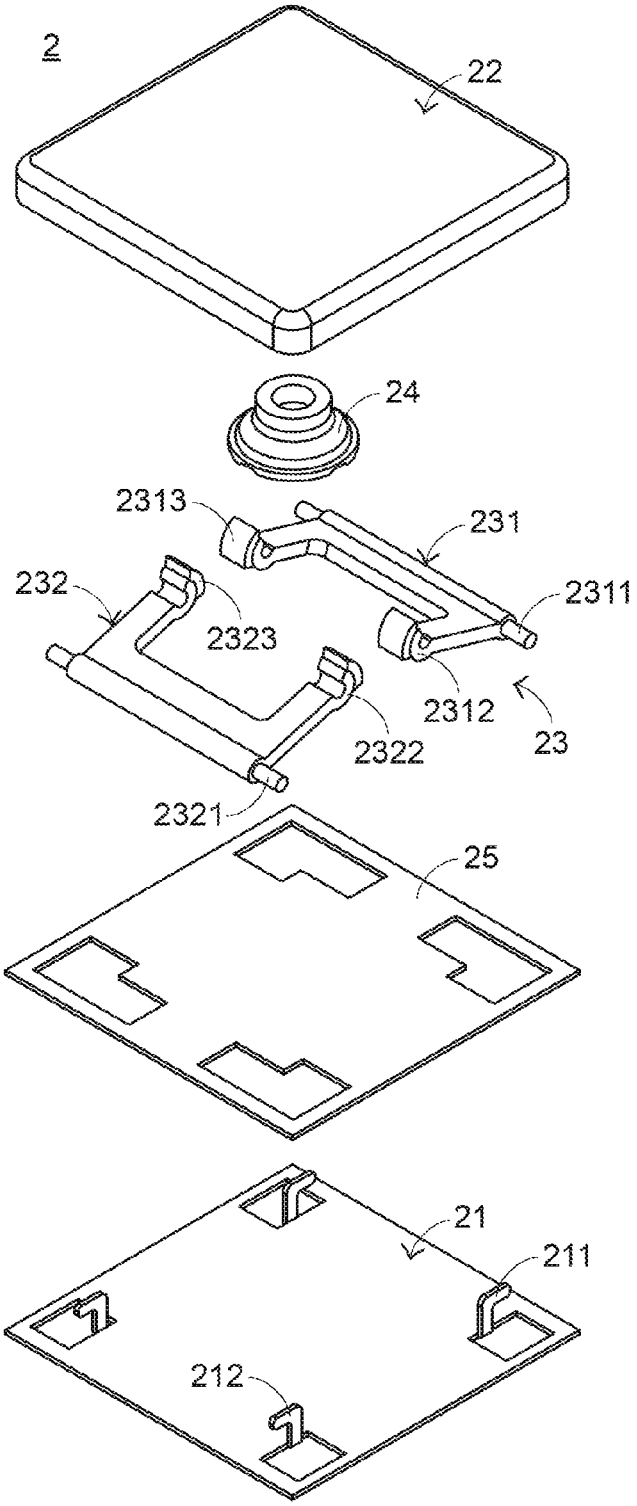
FIG. 2 is a schematic exploded view illustrating a key structure according to a first embodiment of the present invention.
Figure 3:
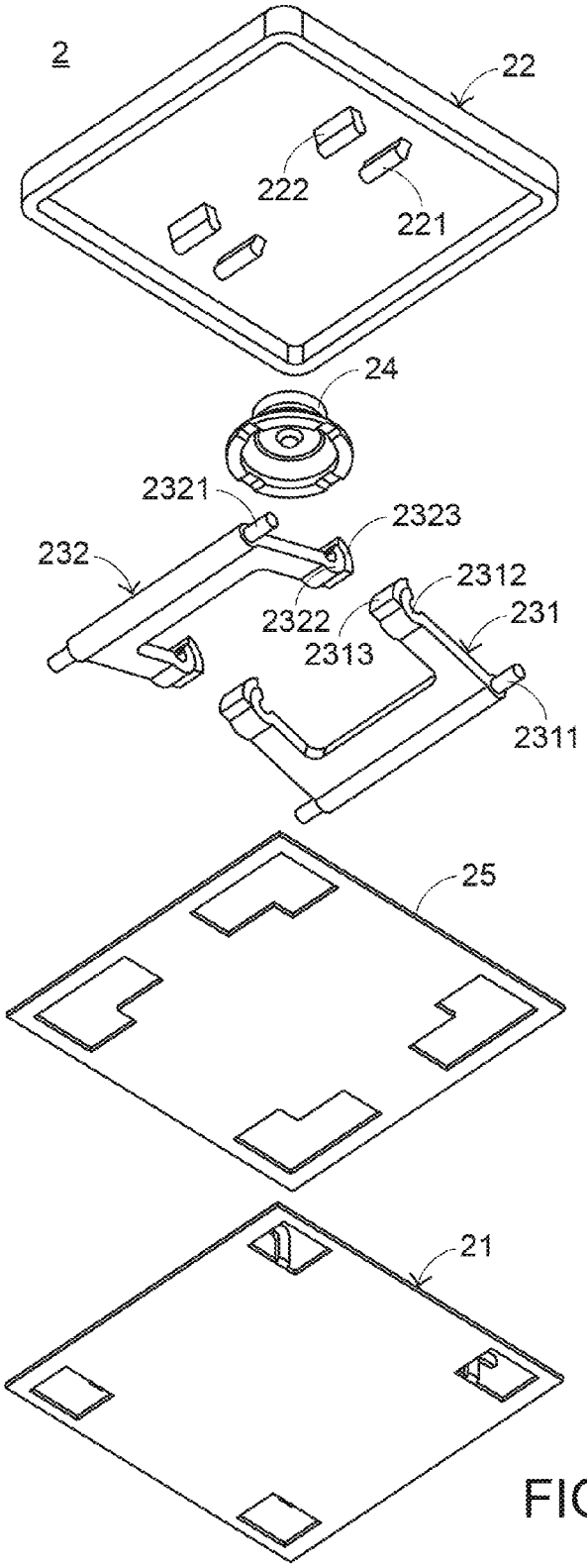
FIG. 3 is a schematic exploded view illustrating the key structure according to the first embodiment of the present invention and taken along another viewpoint.

FIG. 2 is a schematic exploded view illustrating a key structure according to a first embodiment of the present invention. FIG. 3 is a schematic exploded view illustrating the key structure according to the first embodiment of the present invention and taken along another viewpoint. As shown in FIGS. 2 and 3, the key structure 2 comprises a base plate 21, a keycap 22, a connecting element 23, an elastic element 24 and a switch circuit board 25. The base plate 21 comprises a first hook 211 and a second hook 212. The first hook 211 and the second hook 212 are connectable with the connecting element 23. The keycap 22 is disposed over the base plate 21 and exposed to the outside. When a depressing force of the user is applied to the keycap 22, the keycap 22 is moved relative to the base plate 21. The keycap 22 comprises a first bulge 221 and a second bulge 222. Both of the first bulge 221 and the second bulge 222 are disposed on a bottom surface of the keycap 22. The connecting element 23 is arranged between the base plate 21 and the keycap 22. The base plate 21 and the keycap 22 are connected with each other through the connecting element 23. As the connecting element 23 is swung, the keycap 22 is correspondingly moved relative to the base plate 21. In an embodiment, the connecting element 23 comprises a first frame 231 and a second frame 232.

The structure of the connecting element 23 will be described as follows. The first frame 231 is located at a first side of the key structure 2. A first end of the first frame 231 is connected with the base plate 21. A second end of the first frame 231 is connected with the keycap 22. The first frame 231 comprises a first rotary shaft 2311, a first coupling part 2312 and a first linking part 2313. The first rotary shaft 2311 is formed on the first end of the first frame 231. When the first rotary shaft 2311 is connected with the first hook 211 of the base plate 21, the first rotary shaft 2311 is rotatable within the first hook 211. The first coupling part 2312 is formed on the second end of the first frame 231. When the first coupling part 2312 is connected with the first bulge 221 of the keycap 22, the first coupling part 2312 is rotatable relative to the first bulge 221. Preferably, the first coupling part 2312 is connected with the first bulge 221 through engagement. The first linking part 2313 is formed on the second end of the first frame 231. Particularly, the first linking part 2313 is formed on an outer surface of the first coupling part 2312.

The second frame 232 is located at a first side of the key structure 2. A first end of the second frame 232 is connected with the base plate 21. A second end of the second frame 232 is connected with the keycap 22. The second frame 232 comprises a second rotary shaft 2321, a second coupling part 2322 and a second linking part 2323. The second rotary shaft 2321 is formed on the first end of the second frame 232. When the second rotary shaft 2321 is connected with the second hook 212 of the base plate 21, the second rotary shaft 2321 is rotatable within the second hook 212. The second coupling part 2322 is formed on the second end of the second frame 232. When the second coupling part 2322 is connected with the second bulge 222 of the keycap 22, the second coupling part 2322 is rotatable relative to the second bulge 222. Preferably, the second coupling part 2322 is connected with the second bulge 222 through engagement. The second linking part 2323 is formed on the second end of the second frame 232. Particularly, the second linking part 2323 is formed on an outer surface of the second coupling part 2322 and located near the first linking part 2313.

Please refer to FIGS. 2 and 3 again. The switch circuit board 25 is disposed on the base plate 21. When the switch circuit board 25 is triggered, a corresponding key signal is generated. The elastic element 24 is arranged between the keycap 22 and the switch circuit board 25. As the elastic element 24 is pushed by the keycap, the elastic element 24 is compressed to trigger the switch circuit board 25. When the elastic element 24 is restored from the compressed state to the original shape, the elastic element 24 provides an elastic force. In response to the elastic force, the keycap 22 is returned to an original position where the keycap 22 is not depressed. Preferably but not exclusively, the elastic element 24 is a rubbery elastomer, and the switch circuit board 25 is a membrane switch circuit board.

Figure 4:
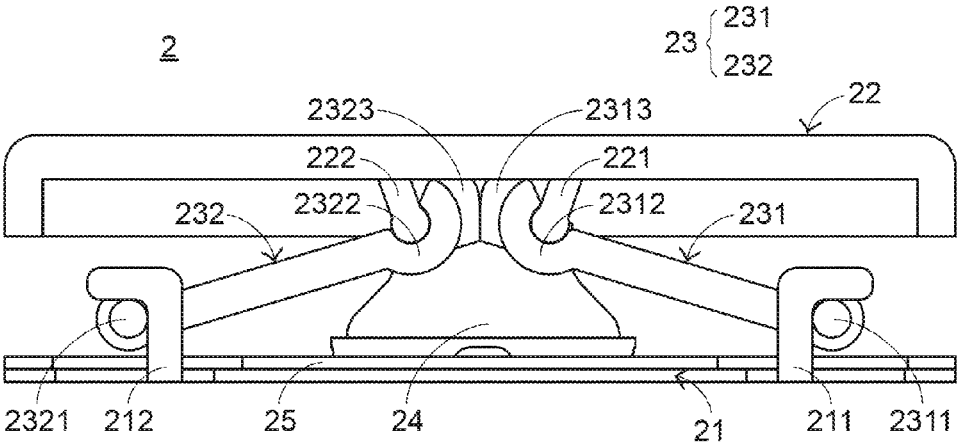
FIG. 4 is a schematic side cross-sectional view illustrating the key structure according to the first embodiment of the present invention.
Figure 5:
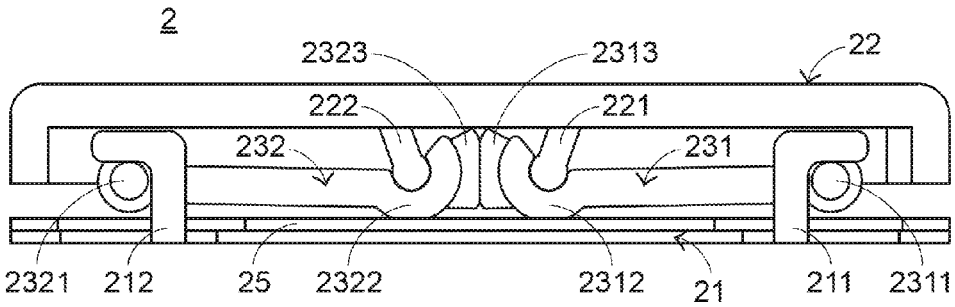
FIG. 5 is a schematic side cross-sectional view illustrating the key structure according to the first embodiment of the present invention, in which the keycap is depressed.

The operations of the conventional key structure 2 in response to the depressing action of the user will be illustrated as follows. Please refer to FIGS. 4 and 5. FIG. 4 is a schematic side cross-sectional view illustrating the key structure according to the first embodiment of the present invention. FIG. 5 is a schematic side cross-sectional view illustrating the key structure according to the first embodiment of the present invention, in which the keycap is depressed. As shown in FIG. 4, the keycap 22 of the key structure 2 is not depressed. Meanwhile, the first linking part 2313 and the second linking part 2323 are in contacted with each other. When a depressing force from the user is applied to the keycap 22 and received by the keycap 22, the first frame 231 that is connected with the keycap 231 is swung relative to the second frame 232. Due to the friction between the first linking part 2313 and the second linking part 2323, the keycap 22 is moved downwardly. As the keycap 22 is moved downwardly, the elastic element 24 is pushed by the keycap 22. At the same time, the elastic element 24 is subjected to deformation (i.e., in a compressed state) to push the switch circuit board 25 and trigger the corresponding key intersection (not shown) of the switch circuit board 25. Consequently, the switch circuit board 25 generates a corresponding key signal.

When the keycap 22 is no longer depressed by the user, no depressing force is applied to the keycap 22 and the elastic element 24 is no longer pushed by the keycap 22. In response to the elasticity of the elastic element 24, the elastic element 24 is restored to its original shape to provide an upward elastic restoring force to the keycap 22. As the keycap 22 is moved upwardly and the connecting element 23 is correspondingly swung, the keycap 22 is returned to its original position where it is not depressed.

In an embodiment, the first linking part 2313 and the first frame 231 are collaboratively produced by a double injection process, and the second linking part 2323 and the second frame 232 are also collaboratively produced by the double injection process. Moreover, the first linking part 2313 and the second linking part 2323 are made of rubbery material or thermoplastic polyurethane (TPU). After the key structure 2 is assembled, the first linking part 2313 and the second linking part 2323 are continuously contacted with each other in response to the elasticities thereof. Even if the production tolerances of the first frame 231 and the second frame 232 are very large, the production tolerances can be compensated by the first linking part 2313 and the second linking part 2323. Consequently, the keycap 22 is stably moved, and the rocking extent of the keycap 22 is reduced.

Figure 6:
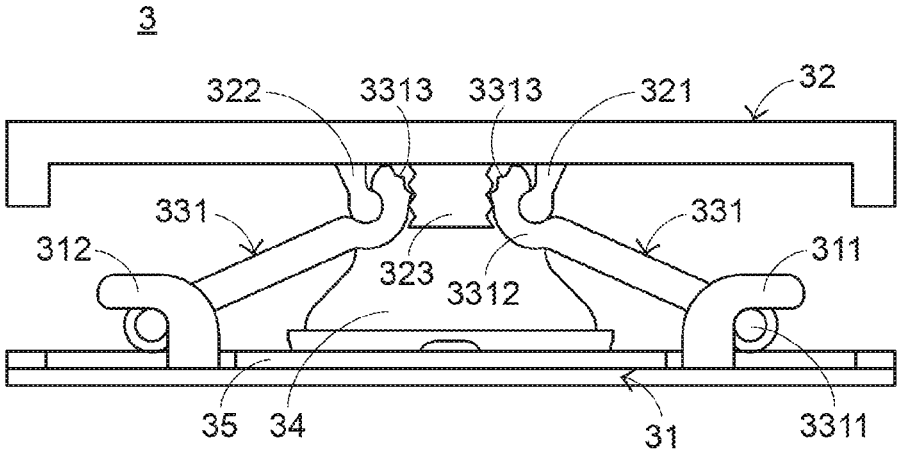
FIG. 6 is a schematic side cross-sectional view illustrating a key structure according to a second embodiment of the present invention.
Figure 7:
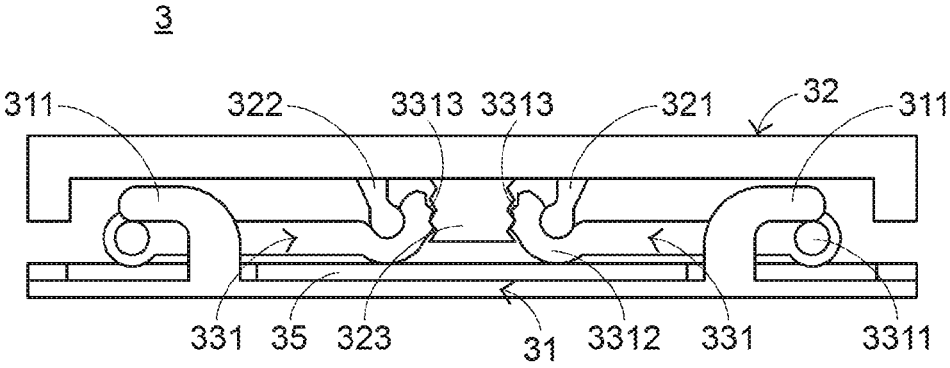
FIG. 7 is a schematic side cross-sectional view illustrating the key structure according to the second embodiment of the present invention, in which the keycap is depressed.

The present invention further provides a key structure of a second embodiment, which is distinguished from the first embodiment. FIG. 6 is a schematic side cross-sectional view illustrating a key structure according to a second embodiment of the present invention. FIG. 7 is a schematic side cross-sectional view illustrating the key structure according to the second embodiment of the present invention, in which the keycap is depressed. As shown in FIGS. 6 and 7, the key structure 3 comprises a base plate 31, a keycap 32, a connecting element 33, an elastic element 34 and a switch circuit board 35. The base plate 31 comprises a first hook 311 and a second hook 312. The connecting element 33 comprises two frames 331. Except for the following two items, the key structure 3 of this embodiment is substantially identical to that of the key structure 2 of the first embodiment, and is not redundantly described herein. Firstly, the structure of the keycap 32 is distinguished. Secondly, the structure of the frame 331 is distinguished.

The structure of the keycap 32 will be described as follows. The keycap 32 comprises a first bulge 321, a second bulge 322 and a first linking part 323. All of the first bulge 321, the second bulge 322 and the first linking part 323 are disposed on a bottom surface of the keycap 32. The first bulge 321 and the second bulge 322 are on two opposite sides of the first linking part 323. In this embodiment, the first linking part 323 is a saw-toothed structure.

A first end of the frame 331 is connected with the base plate 31. A second end of the frame 331 is connected with the keycap 32. The frame 331 comprises a rotary shaft 3311, a coupling part 3312 and a second linking part 3313. The rotary shaft 3311 is formed on the first end of the frame 331. When the rotary shaft 3311 is connected with the first hook 311 or the second hook 312 of the base plate 31, the rotary shaft 3311 is rotatable within the first hook 311 or the second hook 312. The coupling part 3312 is formed on the second end of the frame 331. When the coupling part 3312 is connected with the first bulge 321 or the second bulge 322 of the keycap 32, the coupling part 3312 is rotatable relative to the first bulge 321 or the second bulge 322. Preferably, the coupling part 3312 is connected with the first bulge 321 or the second bulge 322 through engagement. The second linking part 3313 is formed on the second end of the frame 331. Particularly, the second linking part 3313 is formed on an outer surface of the coupling part 3312. In this embodiment, the second linking part 3313 is also a saw-toothed structure corresponding to the first linking part 323.

Please refer to FIGS. 6 and 7 again. The operations of the conventional key structure 3 in response to the depressing action of the user will be illustrated as follows. As shown in FIG. 6, the keycap 32 of the key structure 3 is not depressed. Meanwhile, the first linking part 323 and the second linking part 3313 are in contacted with each other and engaged with each other. When a depressing force from the user is applied to the keycap 32 and received by the keycap 32, the two frames 331 that are connected with the keycap 331 are swung. As the second linking part 3313 is rotated, the first linking part 323 that is engaged with the second linking part 3313 is correspondingly rotated. Consequently, the keycap 32 is moved downwardly. As the keycap 32 is moved downwardly, the elastic element 34 is pushed by the keycap 32. At the same time, the elastic element 34 is changed to a compressed state to push the switch circuit board 35 and trigger the corresponding key intersection (not shown) of the switch circuit board 35. Consequently, the switch circuit board 35 generates a corresponding key signal. The way of returning the keycap 32 to its original position is similar to that mentioned above, and is not redundantly described herein.

From the above descriptions, the key structure of the present invention provides a key structure. The key structure includes a non-scissors connecting element. As the connecting element is swung, a keycap is correspondingly moved. Due to the contact between a first linking part and a second linking part, the keycap is moved with the connecting element. The key structure of the present invention provides a mechanism to compensate the production tolerances of associated components. Consequently, the keycap can be stably moved, and the rocking extent during the movement of the keycap is reduced.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A key structure, comprising:

a base plate;

a keycap disposed over the base plate, wherein when a depressing force is received by the keycap, the keycap is moved relative to the base plate; and a connecting element arranged between the base plate and the keycap, wherein the base plate and the keycap are connected with each other through the connecting element, wherein as the connecting element is swung, the keycap is correspondingly moved relative to the base plate, wherein the connecting element comprises:

a first frame located at a first side of the key structure, wherein a first end of the first frame is connected with the base plate, a second end of the first frame is connected with the keycap, the first frame comprises a first linking part, and the first linking part is formed on the second end of the first frame; and a second frame located at a second side of the key structure, wherein a first end of the second frame is connected with the base plate, a second end of the second frame is connected with the keycap, the second frame comprises a second linking part, and the second linking part is formed on the second end of the second frame and contacted with the first linking part, wherein when the depressing force is received by the keycap, the first frame is swung relative to the second frame, and the keycap is correspondingly moved in response to a friction between the first linking part and the second linking part; wherein the first frame further comprises a first coupling part formed on the second end of the first frame, wherein the first coupling part is connected with a first bulge of the keycap, and the first coupling part is rotatable relative to the first bulge, wherein the first linking part is formed on an outer surface of the first coupling part; and wherein the second frame further comprises a second coupling part formed on the second end of the second frame, wherein the second coupling part is connected with a second bulge of the keycap, and the second coupling part is rotatable relative to the second bulge, wherein the second linking part is formed on an outer surface of the second coupling part.

2. The key structure according to claim 1, wherein the first frame further comprises:

a first rotary shaft formed on the first end of the first frame, wherein the first rotary shaft is connected with a first hook of the base plate, and the first rotary shaft is rotatable within the first hook.

3. The key structure according to claim 1, wherein the second frame further comprises:

a second rotary shaft formed on the first end of the second frame, wherein the second rotary shaft is connected with a second hook of the base plate, and the second rotary shaft is rotatable within the second hook.

4. The key structure according to claim 1, wherein the first linking part and the first frame are collaboratively produced by a double injection process, and the second linking part and the second frame are collaboratively produced by the double injection process.

5. The key structure according to claim 1, further comprising:

a switch circuit board disposed on the base plate, wherein when the switch circuit board is triggered, a key signal is generated; and an elastic element arranged between the keycap and the switch circuit board, wherein the switch circuit board is triggered when the elastic element is pushed, or the keycap is returned to an original position in response to an elastic force of the elastic element.

6. The key structure according to claim 1, wherein the first linking part and the second linking part are made of rubbery material or thermoplastic polyurethane.

7. A key structure, comprising:

a base plate;

a keycap disposed over the base plate, wherein when a depressing force is received by the keycap, the keycap is moved relative to the base plate, wherein the keycap comprises a first linking part, and the first linking part is disposed on a bottom surface of the keycap; and a connecting element arranged between the base plate and the keycap, wherein the base plate and the keycap are connected with each other through the connecting element, wherein as the connecting element is swung, the keycap is correspondingly moved relative to the base plate, wherein the connecting element comprises at least one frame, the at least one frame is located at a side of the key structure, a first end of the at least one frame is connected with the base plate, a second end of the at least one frame is connected with the keycap, the at least one frame comprises a second linking part, and the second linking part is formed on the second end of the at least one frame and contacted with the first linking part, wherein when the depressing force is received by the keycap, the second linking part is rotated with the first linking part and the at least one frame is swung, so that the keycap is correspondingly moved.

8. The key structure according to claim 7, wherein the at least one frame further comprises:

a rotary shaft formed on the first end of the at least one frame, wherein the rotary shaft is connected with a hook of the base plate, and the rotary shaft is rotatable within the hook; and a coupling part formed on the second end of the at least one frame, wherein the coupling part is connected with a bulge of the keycap, and the coupling part is rotatable relative to the bulge, wherein the second coupling part is formed on an outer surface of the coupling part.

9. The key structure according to claim 7, wherein the first linking part and the second linking part are saw-toothed structures, and the second linking part is integrally formed with the at least one frame.

10. The key structure according to claim 7, further comprising:

a switch circuit board disposed on the base plate, wherein when the switch circuit board is triggered, a key signal is generated; and an elastic element arranged between the keycap and the switch circuit board, wherein the switch circuit board is triggered when the elastic element is pushed, or the keycap is returned to an original position in response to an elastic force of the elastic element.

* * * * *